US011731002B2

(12) United States Patent
Luo et al.

(10) Patent No.: US 11,731,002 B2
(45) Date of Patent: Aug. 22, 2023

(54) COMPREHENSIVE TRAINING EQUIPMENT INCLUDING MULTIPLE ANCHOR POINTS AND ITS METHOD OF USE

(71) Applicant: TREADMIRROR CO. LIMITED, Birmingham (GB)

(72) Inventors: Xietong Luo, Jiangxi (CN); Zhanfei He, Jiangxi (CN)

(73) Assignee: TREADMIRROR CO. LIMITED, Birmingham (GB)

( * ) Notice: Subject to any disclaimer, the term of this patent is extended or adjusted under 35 U.S.C. 154(b) by 40 days.

(21) Appl. No.: 17/510,359

(22) Filed: Oct. 25, 2021

(65) Prior Publication Data

US 2023/0066165 A1 Mar. 2, 2023

(30) Foreign Application Priority Data

Aug. 24, 2021 (CN) ..... 202110972803.3

(51) Int. Cl.
*A63B 22/02* (2006.01)
*A63B 21/02* (2006.01)
*A63B 23/035* (2006.01)

(52) U.S. Cl.
CPC ..... *A63B 22/02* (2013.01); *A63B 21/02* (2013.01); *A63B 23/03575* (2013.01)

(58) Field of Classification Search
CPC .... A63B 22/02; A63B 21/02; A63B 23/03575
See application file for complete search history.

(56) References Cited

U.S. PATENT DOCUMENTS 4,406,451 A * 9/1983 Gaetano ..... A61H 15/00 403/113
6,302,829 B1 * 10/2001 Schmidt ..... A63B 22/203 482/70
2004/0043873 A1 * 3/2004 Wilkinson ..... A63B 21/00065 482/52
2008/0070757 A1 3/2008 Albert
(Continued)

FOREIGN PATENT DOCUMENTS

CN 205649782 U 10/2016
CN 208193487 U 12/2018
(Continued)

OTHER PUBLICATIONS

The Search report of CN application No. 202110972803.3 dated Apr. 27, 2022.
(Continued)

*Primary Examiner* — Sundhara M Ganesan
*Assistant Examiner* — Jacqueline N L Loberiza
(74) *Attorney, Agent, or Firm* — Andrew C. Cheng

(57) ABSTRACT

A comprehensive training equipment includes a bottom base and a walking and running platform provided on the bottom base. The comprehensive training equipment is provided with a plurality of anchor points configured for anchoring a pull rope. The comprehensive training equipment can carry out aerobic and strength training and realize whole-body muscle exercise by setting multiple anchor points for anchoring a pull rope on the comprehensive training equipment, so as to save cost and space, and can be widely used in small fitness venues and families with limited site area available.

8 Claims, 6 Drawing Sheets

(56) References Cited

U.S. PATENT DOCUMENTS

| | | | | |
|---|---|---|---|---|
| 2010/0279827 | A1* | 11/2010 | Farnsworth ..... | A63B 21/4035 482/54 |
| 2016/0287929 | A1* | 10/2016 | Poole ..... | A63B 21/0552 |
| 2018/0200567 | A1 | 7/2018 | Rubin et al. | |

FOREIGN PATENT DOCUMENTS

| | | | | |
|---|---|---|---|---|
| GB | 2515470 | A | | 12/2014 |
| JP | 2022027155 | A | * | 2/2022 |
| KR | 20060089909 | A | | 8/2006 |
| TW | 536959 | U | | 6/2003 |
| WO | 2018218638 | A1 | | 12/2018 |

OTHER PUBLICATIONS

The Office action of CN application No. 202110972803.3 dated Apr. 27, 2022.
The European search report of EP application No. 21204284.0 dated May 10, 2022.

* cited by examiner

COMPREHENSIVE TRAINING EQUIPMENT INCLUDING MULTIPLE ANCHOR POINTS AND ITS METHOD OF USE

CROSS-REFERENCE TO RELATED APPLICATION

The present invention is based on and claims the priority of Chinese patent application No. 202110972803.3, which is filed on Aug. 24, 2021. The contents of the above-identified application are incorporated herein by reference.

TECHNICAL FIELD

The present invention relates to the technical field of fitness equipment, and in particular, to a comprehensive training equipment including multiple anchor points and its method of use.

BACKGROUND OF THE INVENTION

Fitness has become a more and more widely accepted way of life. More and more commercial fitness venues appear. At the same time, fitness equipment has gradually entered thousands of families. However, the fitness equipment generally has a single function, and in order to meet different exercise needs, the user needs to buy a variety of different fitness equipment. This is a huge challenge for some small fitness venues, especially for families, due to the site area requirement and the cost investment. Therefore, a comprehensive training equipment is needed to solve the above problems.

The foregoing description is intended to provide general background information and does not necessarily constitute the prior art.

SUMMARY OF THE INVENTION

In view of the above, the present invention provides a comprehensive training equipment including multiple anchor points and its method of use, which can realize various training exercises through one equipment.

The present invention provides a comprehensive training equipment comprising a bottom base and a walking and running platform provided on the bottom base, wherein the comprehensive training equipment is provided with a plurality of anchor points configured for anchoring a pull rope.

Further, the anchor points comprise two first anchor points located in a middle of the bottom base and/or two second anchor points located at a rear end of the bottom base.

Further, the comprehensive training equipment comprises two vertical columns provided at a front end of the bottom base, and the anchor points comprise two third anchor points located at an upper end of the two vertical columns and/or two fourth anchor points located at a lower end of the two vertical columns.

Further, the comprehensive training equipment comprises two vertical columns provided at a front end of the bottom base, an upper end of each of the two vertical columns is provided with a vertical fixing hole and a horizontal fixing hole, which are respectively used to install a movable rod vertically or horizontally backward;

the anchor points comprise two fifth anchor points located at a top end of two movable rods when the two movable rods are vertically installed on the vertical fixing holes of the two vertical columns; and when the two movable rods are installed horizontally backward on the horizontal fixing holes of the two vertical columns, the two movable rods are each used as a handle during running or walking training.

Further, the vertical fixing hole and the horizontal fixing hole are threaded holes, and one end of the movable rod is correspondingly provided with a threaded pipe to be fixed with the threaded hole.

Further, the comprehensive training equipment comprises two vertical columns provided at a front end of the bottom base, two movable rods are respectively pivoted to an upper end of the two vertical columns, and each movable rod is pivotable between a vertical position and a horizontal position;

the anchor points comprise two fifth anchor points located at a top end of the two movable rods when the two movable rods are rotated to the vertical position; and when the two movable rods are rotated to the horizontal position, the two movable rods are each used as a handle during running or walking training.

Further, the comprehensive training equipment comprises two vertical columns provided at a front end of the bottom base, two vertical rods are respectively fixed on an upper end of the two vertical columns, and the anchor points comprise two fifth anchor points located at a top end of the two vertical rods.

Further, a handle is further mounted horizontally backward on the upper end of each of the two vertical columns.

Further, the anchor points comprise two first anchor points located in a middle of the bottom base and two second anchor points located at a rear end of the bottom base.

Further, the comprehensive training equipment comprises two vertical columns provided at a front end of the bottom base, and the anchor points further comprise two third anchor points located at an upper end of the two vertical columns and two fourth anchor points located at a lower end of the two vertical columns.

Further, each of the first anchor point, the second anchor point, the third anchor point and the fourth anchor point comprises a rope anchoring member, one end of the rope anchoring member is provided with a through hole configured for anchoring the pull rope, the rope anchoring member can be switched between a use state and a non-use state; in the use state, the through hole of the rope anchoring member exposes from the bottom base or exposes from the vertical column; in the non-use state, the through hole of the rope anchoring member is hidden into the bottom base or hidden into the vertical column.

Further, each of the first anchor point, the second anchor point, the third anchor point and the fourth anchor point further comprises a rotating operation member, the rotating operation member and the rope anchoring member are fixed to each other, such that the rotating operation member can drive the rope anchoring member, so as to enable the rope anchoring member to switch between the use state and the non-use state.

Further, two movable rods or two vertical rods are connected to an upper end of the two vertical columns respectively, the anchor points further comprise two fifth anchor points located at a top end of the two movable rods or the two vertical rods.

Further, the fifth anchor point is an annular groove provided at the top end of the movable rod or the vertical rod.

The present invention further provides a method for using the above comprehensive training equipment, comprising:

installing a pull rope at the first anchor point, and holding the end of the pull rope for vertical pull-up training;

installing a pull rope at the second anchor point, tying the pull rope to the waist, and holding the movable rod or the vertical rod for waist resistance training;

installing a pull rope at the third anchor point, and holding the end of the pull rope for horizontal pull training;

installing a pull rope at the fourth anchor point, and holding the end of the pull rope for oblique pull-up training; and installing a pull rope at the fifth anchor point, and holding the end of the pull rope for pull-down training.

The comprehensive training equipment and its use methods provided by the present invention can carry out aerobic and strength training and realize whole-body muscle exercise by setting multiple, anchor points for anchoring the pull rope on the comprehensive training equipment, so as to save cost and space, and can be widely used in small fitness venues and families with limited site area available.

DETAILED DESCRIPTION OF PREFERRED EMBODIMENTS

Specific embodiments of the present invention are described in further detail below in conjunction with the accompanying drawings. The following embodiments are used to illustrate the present invention, but are not used to limit the scope of the present invention.

Figure 1:
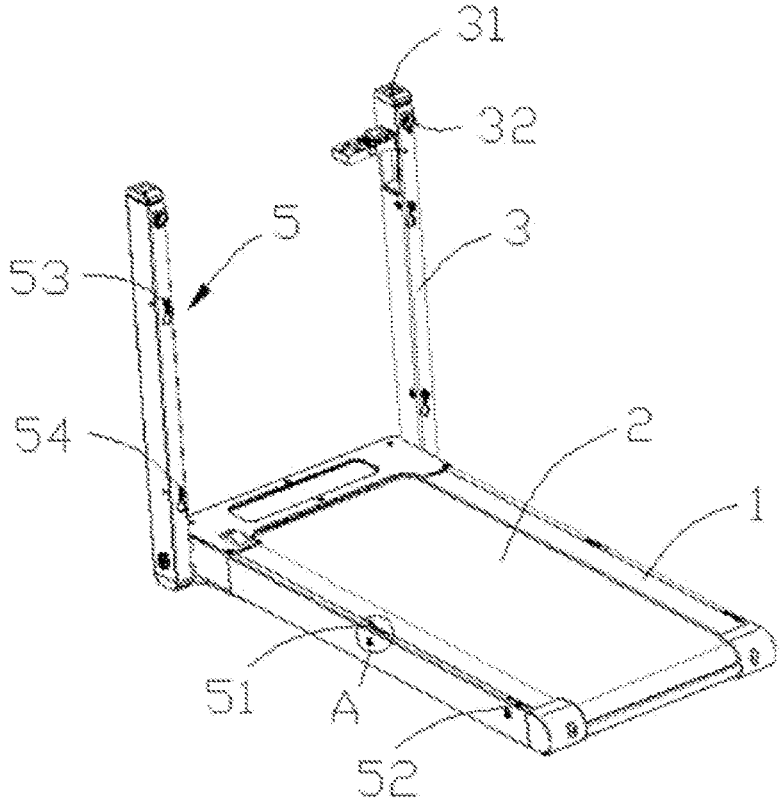
FIG. 1 is a structural diagram of a comprehensive training equipment according to an embodiment of the present invention.

As shown in FIG. 1, in this embodiment, a comprehensive training equipment including multiple rope anchor points includes a bottom base 1, a walking and running platform 2 provided on the bottom base 1, and two vertical columns 3 located at the front end of the bottom base 1. The upper end of each of the two vertical columns 3 is provided with a vertical fixing hole 31 and a horizontal fixing hole 32, which are respectively used to install a movable rod 4 vertically or horizontally backward. In this embodiment, both the vertical fixing hole 31 and the horizontal fixing hole 32 are threaded holes, and one end of the movable rod 4 is correspondingly provided with a threaded pipe to be fixed with the threaded hole. In other embodiments, other different connection methods can also be adopted, for example, the movable rod 4 is pivoted to the upper end of the vertical column 3, such that the movable rod 4 is pivotable between a horizontal position and a vertical position, and is fixed with the vertical column 3 in the horizontal position and the vertical position through a locking structure such as buckles, fasteners, pins or other structures.

Figure 2:
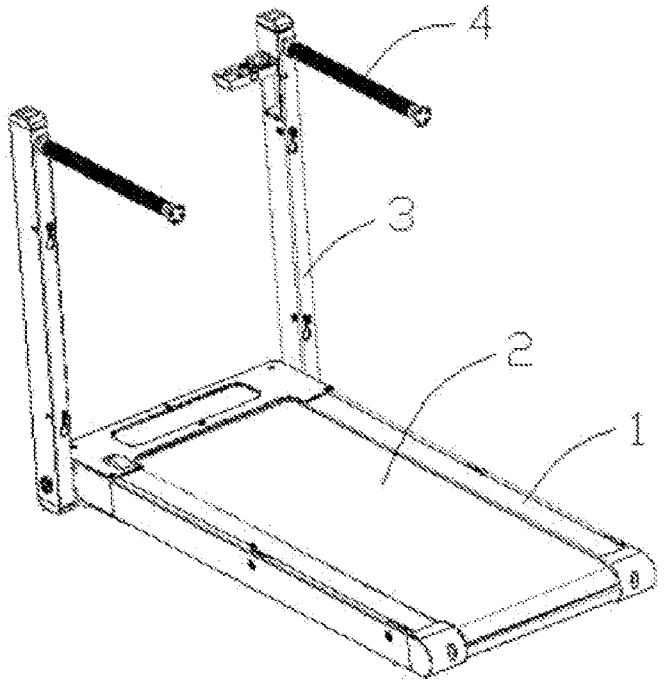
FIG. 2 is a structural diagram of the comprehensive training equipment shown in FIG. 1 with the movable rod installed in a first position.

In this embodiment, the walking and running platform 2 is used as a running platform, and the user can carry out running training on the walking and running platform 2. When the movable rod 4 is installed horizontally backward on the horizontal fixing hole 32, the movable rod 4 is used as a handle during running training (as shown in FIG. 2).

In other embodiments, the walking and running platform 2 can be used as a walking platform, and the user can carry out walking training on the walking and running platform 2. In this case, the vertical column 3 may be omitted. Further, the vertical column 3 can also be detachably or foldably fixed to the bottom base 1, such that the vertical column 3 is detached or folded when the walking and running platform 2 is used as a walking platform, and is reinstalled or opened when the walking and running platform 2 is used as a running platform.

Figure 3:
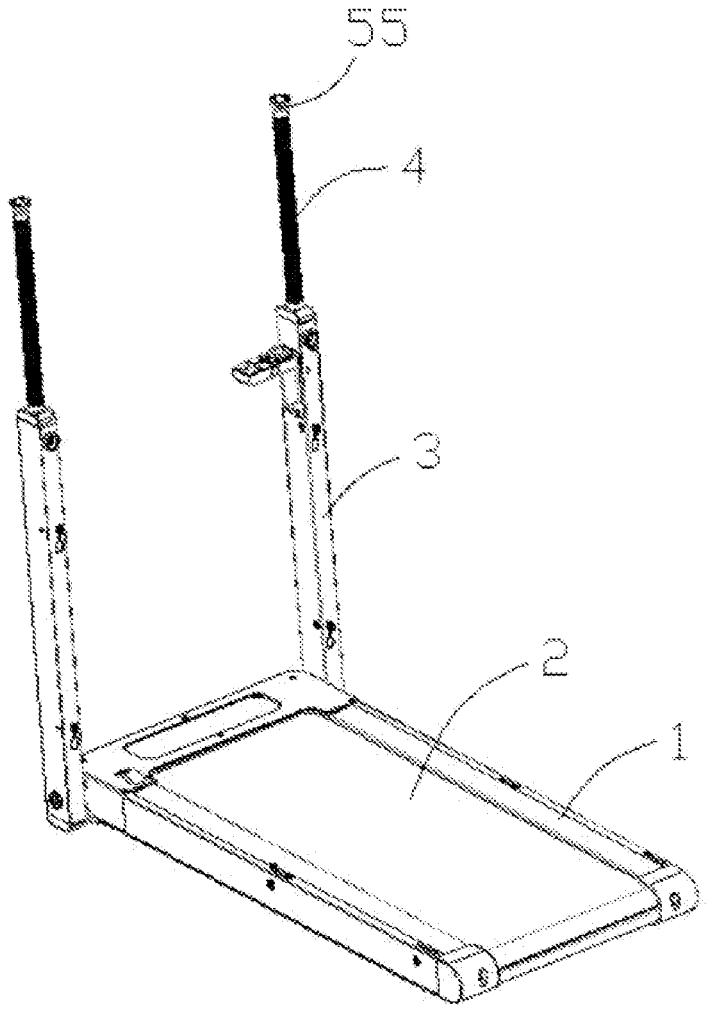
FIG. 3 is a structural diagram of the comprehensive training equipment shown in FIG. 1 with the movable rod installed in a second position.

In this embodiment, the comprehensive training equipment is provided with a plurality of anchor points 5 for anchoring a pull rope 8. The anchor points 5 include two first anchor points 51 located in the middle of the bottom base 1, two second anchor points 52 located at the rear end of the bottom base 1, two third anchor points 53 located at the upper end of the two vertical columns 3, two fourth anchor points 54 located at the lower end of the two vertical columns 3, and two fifth anchor points 55 located at the top end of two movable rods 4 when the movable rods 4 are vertically installed on the vertical fixing holes 31 of the two vertical columns 3 (as shown in FIG. 3)

Figure 4:
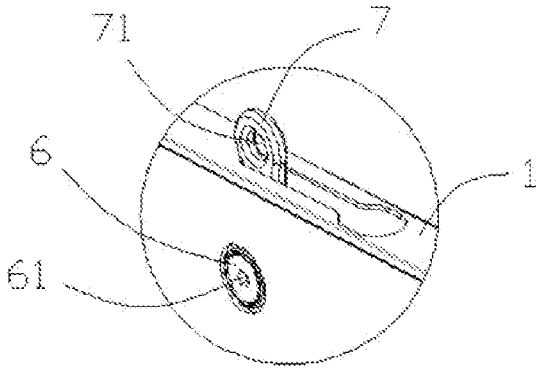
FIG. 4 is a schematic diagram of the anchor point structure at portion A in the comprehensive training equipment shown in FIG. 1 in a use state.
Figure 5:
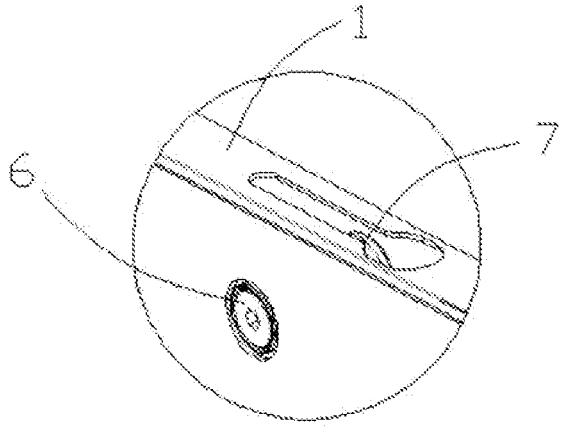
FIG. 5 is a schematic diagram of the anchor point structure at portion A in the comprehensive training equipment shown in FIG. 1 in a non-use state.

As shown in FIG. 4 and FIG. 5, in this embodiment, the anchor point structure of the first anchor point 51 includes a rotating operation member 6 and a rope anchoring member 7. The rotating operation member 6 is provided with a hexagonal countersunk hole 61, which can be rotated by an Allen wrench. One end of the rope anchoring member 7 is provided with a through hole 71. The rotating operation member 6 and the rope anchoring member 7 are fixed to each other, such that the rotating operation member 6 can drive the rope anchoring member 7, so as to enable the rope anchoring member 7 to switch between a use state and a non-use state. In the use state, the through hole 71 of the rope anchoring member 7 exposes from the bottom base 1 (or exposes from the vertical column 3 for the rope anchoring member 7 on the vertical column 3), in order for the pull rope 8 to be anchored (as shown in FIG. 4). In the non-use state, the through hole 71 of the rope anchoring member 7 is hidden into the bottom base 1 (or hidden into the vertical column 3 for the rope anchoring member 7 on the vertical column 3), in order to avoid collision by the user (as shown in FIG. 5). Here, only the anchor point structure of the first anchor point 51 is described, and the anchor point structures of the second anchor point 52, the third anchor point 53 and the fourth anchor point 54 are the same, which will not be repeated here. The anchor point structure of the fifth anchor point 55 is an annular groove provided at the top end of the movable rod 4. Of course, in other embodiments, these anchor points can also adopt other structures, such as metal hooks directly fixed to the bottom base 1 or the vertical column 3 or the movable rod 4.

Figure 6:
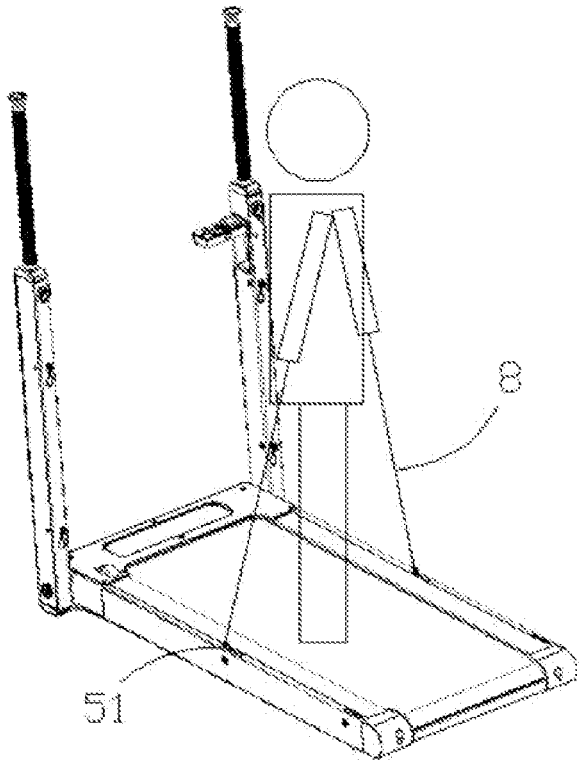
FIG. 6 is a schematic diagram of the comprehensive training equipment shown in FIG. 1 in a first use mode.
Figure 7:
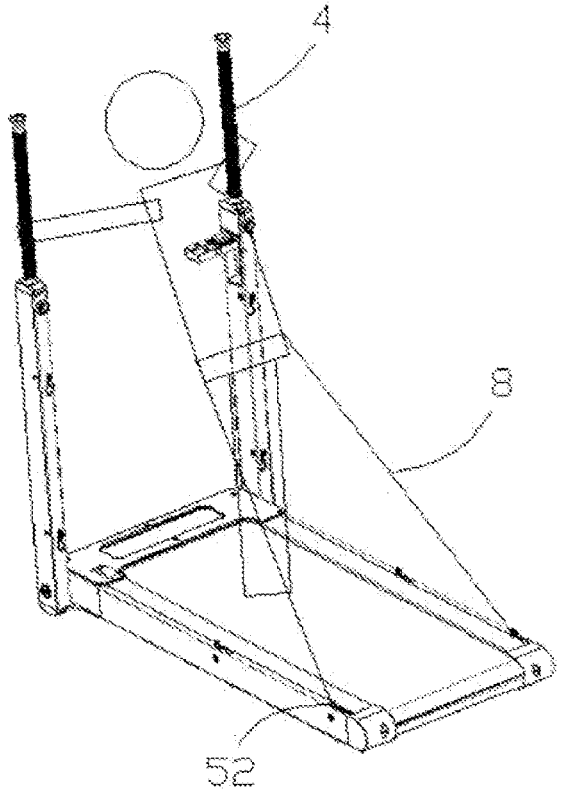
FIG. 7 is a schematic diagram of the comprehensive training equipment shown in FIG. 1 in a second use mode.
Figure 8:
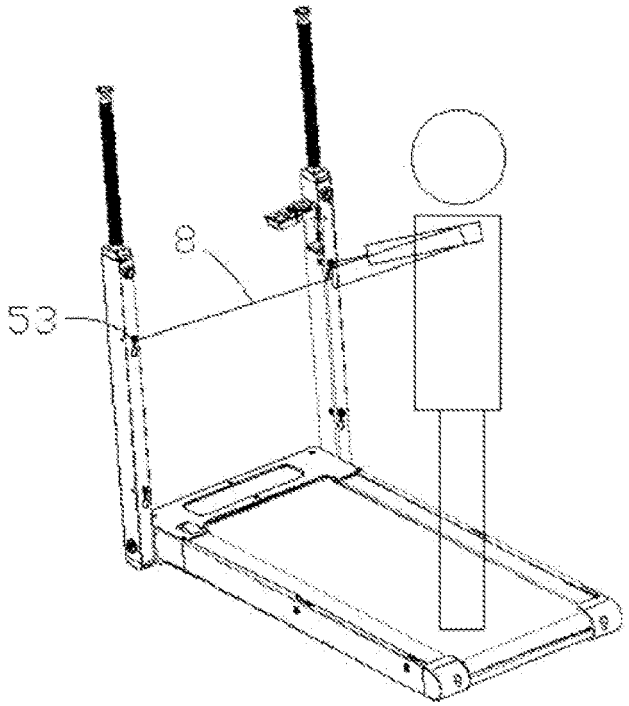
FIG. 8 is a schematic diagram of the comprehensive training equipment shown in FIG. 1 in a third use mode.
Figure 9:
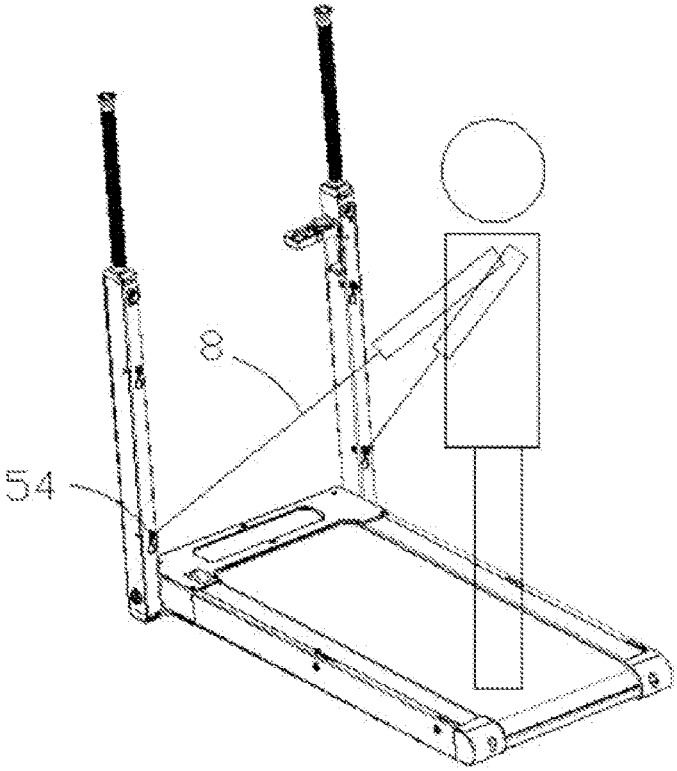
FIG. 9 is a schematic diagram of the comprehensive training equipment shown in FIG. 1 in a fourth use mode.
Figure 10:
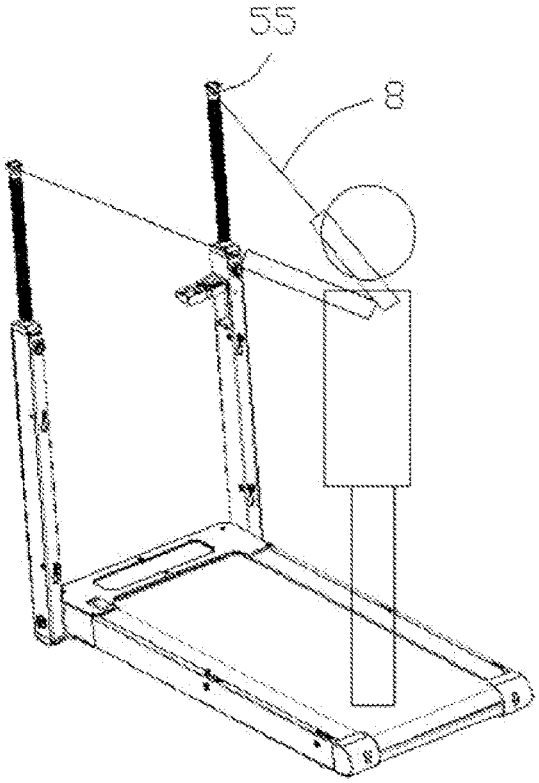
FIG. 10 is a schematic diagram of the comprehensive training equipment shown in FIG. 1 in a fifth use mode.

These anchor points 5 are used to install a pull rope 8 (elastic rope) to carry out vertical pull-up training (as shown in FIG. 6), waist resistance training (as shown in FIG. 7), horizontal pull training (as shown in FIG. 8), oblique pull-up training (as shown in FIG. 9) and pull-down training (as shown in FIG. 10) respectively, so as to realize whole-body muscle exercise.

Of course, in other embodiments, the anchor points 5 may include only some of the first anchor points 51, the second anchor points 52, the third anchor points 53, the fourth anchor points 54 and the fifth anchor points 44 as described above, for carrying out some of these rope pulling trainings. For example, if only the first anchor points 51, the third anchor points 53, the fourth anchor points 54 and the fifth anchor points 55 are included, they are used for carrying out trainings such as vertical pull-up training, horizontal pull training, oblique pull-up training, pull-down training, etc.

In this embodiment, a display device (not shown) is also placed in front of the comprehensive training equipment to display the video course and provide training guidance to the user. Of course, the display device may not be provided, or the display device may be placed in other positions, such as being fixed between the vertical columns 3.

The above comprehensive training equipment may be used in multiple use methods as follows:

install a pull rope 8 at the first anchor point 51, and hold the end of the pull rope 8 for vertical pull-up training (as shown in FIG. 6);

install a pull rope 8 at the second anchor point 52, tie the pull rope 8 to the waist, and hold the movable rod 4 for waist resistance training (as shown in FIG. 7);

install a pull rope 8 at the third anchor point 53, and hold the end of the pull rope 8 for horizontal pull training (as shown in FIG. 8);

install a pull rope 8 at the fourth anchor point 54, and hold the end of the pull rope 8 for oblique pull-up training (as shown in FIG. 9);

install the movable rod 4 vertically on the vertical fixing hole 31, install a pull rope 8 at the fifth anchor point 55, and hold the end of the pull rope 8 for pull-down training (as shown in FIG. 10); and install the movable rod 4 horizontally backward on the horizontal fixing hole 32, the movable rod 4 is used as a handle for running or walking training.

Of course, if the anchor points 5 only includes some of the above-mentioned first anchor point 51, second anchor point 52, third anchor point 53, fourth anchor point 54 and fifth anchor point 55, the use methods only include the use methods corresponding to the included anchor points.

Compared with the prior art, the comprehensive training equipment and its use methods in this embodiment can carry out aerobic and strength training and realize whole-body muscle exercise by setting multiple anchor points for anchoring the pull rope on the comprehensive training equipment, so as to save cost and space, and can be widely used in small fitness venues and families with limited site area available. In addition, the upper end of each of the two vertical columns is provided with the vertical fixing hole and the horizontal fixing hole, which are respectively used to install the movable rod vertically or horizontally backward, so that the movable rod can provide the fifth anchor point or be used as the handle during running or walking training. Thus, this embodiment can reduce parts, has convenient operation and occupies small space.

Figure 11:
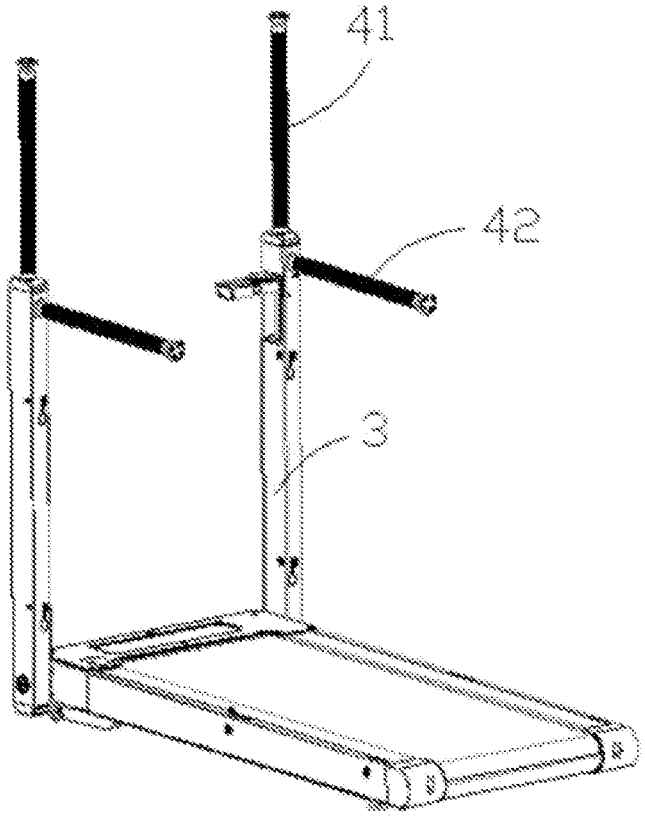
FIG. 11 is a structural diagram of a comprehensive training equipment according to another embodiment of the present invention.

In other embodiments, as shown in FIG. 11, a vertical rod 41 is fixed on the upper end of each of the two vertical columns 3 (for example, the vertical rod 41 may be integrally formed on the vertical column 3), and a handle 42 is further mounted horizontally backward on the upper end of each of the two vertical columns 3 (or the handle 42 may be omitted according to actual requirements), such that the comprehensive training equipment shown in FIG. 11 can be used directly without the need to install (or switch) the movable rod 4 to the vertical fixing hole 31 as required in the embodiment shown in FIGS. 1-10. The fifth anchor point 55 can be set at the top of the vertical rod 41 for rope pulling training.

The comprehensive training equipment with this structure includes the following use methods: installing a pull rope at the first anchor point and holding the end of the pull rope for vertical pull-up training; installing a pull rope at the second anchor point, tying the pull rope to the waist, and holding the movable rod or the vertical rod for waist resistance training; installing a pull rope at the third anchor point and holding the end of the pull rope for horizontal pull training; installing a pull rope at the fourth anchor point and holding the end of the pull rope for oblique pull-up training; installing a pull rope at the fifth anchor point of the movable rod (or the vertical rod) and holding the end of the pull rope for pull-down training. As such, a user can carry out aerobic and strength training and realize whole-body muscle exercise through anchoring a pull rope to different anchor points provided on the comprehensive training equipment. Similarly, if the anchor points only include some of the above first anchor point, second anchor point, third anchor point, fourth anchor point and fifth anchor point, the use methods only include the use methods corresponding to the included anchor points.

In this description, the azimuth or positional relationship indicated by the terms "up", "down", "front", "back", "left", "right", "top", "bottom", "inside", "outside", "vertical", "horizontal" is based on the azimuth or positional relationship shown in the accompanying drawings, only for the sake of clarity and convenience of description of the technical solution. Therefore, it cannot be understood as a limitation of the present invention.

In this description, the terms "first", "second", "third" and the like are only used to distinguish elements from each other, and cannot be understood as indicating or implying specific order or relative importance.

In this description, the terms "include", "comprise", or any other variation thereof are intended to cover non-exclusive inclusion, including not only those elements listed, but also other elements not explicitly listed.

The above is only the specific embodiments of the present invention, but the protection scope of the present invention is not limited to this. Any person skilled in the technical field can easily think of changes or replacements within the technical scope disclosed by the present invention, which should be covered by the protection scope of the present invention. Therefore, the protection scope of the present invention shall be subject to the appended claims.

What is claimed is:

1. A comprehensive training equipment comprising a bottom base and a walking and running platform provided on the bottom base, wherein the comprehensive training equipment is provided with a plurality of anchor points configured for anchoring a pull rope;

wherein the anchor points comprise two first anchor points located in a middle of the bottom base and two second anchor points located at a rear end of the bottom base;

wherein the comprehensive training equipment comprises two vertical columns provided at a front end of the bottom base, and the anchor points further comprise two third anchor points and two fourth anchor points, each of the two third anchor points is located at an upper end of each of the two vertical columns, and each of the two fourth anchor points is located at a lower end of each of the two vertical columns;

wherein each of the first anchor point, the second anchor point, the third anchor point and the fourth anchor point comprises a rope anchoring member, one end of the rope anchoring member is provided with a through hole configured for anchoring the pull rope, the rope anchoring member can be switched between a use state and a non-use state; in the use state, the through hole of the rope anchoring member exposes from the bottom base or exposes from the vertical column; in the non-use state, the through hole of the rope anchoring member is hidden into the bottom base or hidden into the vertical column.

2. The comprehensive training equipment according to claim 1, wherein the upper end of each of the two vertical columns is provided with a vertical fixing hole and a horizontal fixing hole, which are used to install a movable rod vertically or horizontally backward;

the anchor points further comprise two fifth anchor points, and each of the two fifth anchor points is located at a top end of each of two movable rods when the two movable rods are vertically installed on the vertical fixing holes of the two vertical columns;

when the two movable rods are installed horizontally backward on the horizontal fixing holes of the two vertical columns, the two movable rods are each used as a handle during running or walking training.

3. The comprehensive training equipment according to claim 1, wherein two vertical rods are respectively fixed on an upper end of the two vertical columns, and the anchor points further comprise two fifth anchor points, and each of the two fifth anchor points is located at a top end of each of the two vertical rods.

4. The comprehensive training equipment according to claim 3, further comprising two handles, wherein each handle is mounted horizontally backward on the upper end of each of the two vertical columns.

5. The comprehensive training equipment according to claim 1, wherein each of the first anchor point, the second anchor point, the third anchor point and the fourth anchor point further comprises a rotating operation member, the rotating operation member and the rope anchoring member are fixed to each other, such that the rotating operation member can drive the rope anchoring member, so as to enable the rope anchoring member to switch between the use state and the non-use state.

6. The comprehensive training equipment according to claim 1, wherein two movable rods or two vertical rods are connected to an upper end of the two vertical columns respectively, the anchor points further comprise two fifth anchor points, and each of the two fifth anchor points is located at a top end of each of the two movable rods or the two vertical rods.

7. The comprehensive training equipment according to claim 6, wherein each of the two fifth anchor points is an annular groove provided at the top end of the movable rod or the vertical rod.

8. A method for using the comprehensive training equipment according to claim 6, comprising:

installing a pull rope at an anchor point of the two first anchor points, and holding the end of the pull rope for vertical pull-up training;

installing a pull rope at an anchor point of the two second anchor points, tying the pull rope to the waist, and holding the movable rod or the vertical rod for waist resistance training;

installing a pull rope at an anchor point of the two third anchor points, and holding the end of the pull rope for horizontal pull training, installing a pull rope at an anchor point of the two fourth anchor points, and holding the end of the pull rope for oblique pull-up training; and installing a pull rope at an anchor point of the two fifth anchor points, and holding the end of the pull rope for pull-down training.

* * * * *